US012091947B2

(12) United States Patent
Rustin et al.

(10) Patent No.: US 12,091,947 B2
(45) Date of Patent: Sep. 17, 2024

(54) METHOD FOR SEALING FRACTURES IN A SUBTERRANEAN WELL CASING

(71) Applicant: CAN Holdings, LLC, Tallahassee, FL (US)

(72) Inventors: Neil Rustin, Leslie, GA (US); Ann Copple, Cleveland, OK (US); Craig Brown, Cleveland, OK (US)

(73) Assignee: CAN HOLDINGS LLC., Tallahassee, FL (US)

( * ) Notice: Subject to any disclaimer, the term of this patent is extended or adjusted under 35 U.S.C. 154(b) by 0 days.

(21) Appl. No.: 17/873,681

(22) Filed: Jul. 26, 2022

(65) Prior Publication Data

US 2023/0025125 A1 Jan. 26, 2023

Related U.S. Application Data

(60) Provisional application No. 63/225,734, filed on Jul. 26, 2021.

(51) Int. Cl.
*E21B 43/10* (2006.01)
*E21B 33/13* (2006.01)
*E21B 33/138* (2006.01)

(52) U.S. Cl.
CPC ..... *E21B 43/103* (2013.01); *E21B 33/13* (2013.01); *E21B 33/138* (2013.01); *E21B 43/105* (2013.01)

(58) Field of Classification Search
CPC .... E21B 33/138; E21B 43/103; E21B 43/105; E21B 33/13; E21B 42/105; E21B 19/22; E21B 47/002
See application file for complete search history.

(56) References Cited

U.S. PATENT DOCUMENTS 3,358,760 A * 12/1967 Blagg ..... E21B 43/103 166/207
5,957,195 A * 9/1999 Bailey ..... E21B 43/106 166/207
2005/0081358 A1 4/2005 Cook
2005/0161226 A1* 7/2005 Duggan ..... E21B 43/105 166/207
2005/0173115 A1* 8/2005 Maimets ..... E21B 43/103 166/227
2010/0247794 A1 9/2010 Bailey
2013/0206426 A1 8/2013 Whiddon
2020/0056444 A1 2/2020 Benzie et al.
2021/0214601 A1 7/2021 Amanullah et al.

OTHER PUBLICATIONS

International Search Report and Written Opinion issued for PCT/US2022/038357, dated Nov. 15, 2022.

* cited by examiner

*Primary Examiner* — Caroline N Butcher
(74) *Attorney, Agent, or Firm* — Z. Peter Sawicki; Amanda M Prose; Westman, Champlin and Koehler PA

(57) ABSTRACT

A method and an apparatus for sealing perforations or cracks found in an oil well casing. The apparatus includes a hydraulic cylinder with an oil supply section at one end and a rod at another end, a cylindrical liner at least a portion of which is a malleable metal and a receiver; and a frusto-conical wedge being disposed at a lower end of the liner and fixedly connected to the rod. The method includes lowering the apparatus into the well casing and increasing hydraulic pressure to the hydraulic cylinder sufficient to pull the frusto-conical shaped wedge into the liner providing sufficient lateral force to force sufficient liner material into the perforations or cracks of the well casing to seal the well casing wall.

13 Claims, 4 Drawing Sheets

METHOD FOR SEALING FRACTURES IN A SUBTERRANEAN WELL CASING

CROSS-REFERENCE TO RELATED APPLICATION(S)

This application claims the benefit of priority pursuant to 35 U.S.C. § 119(e) to U.S. provisional Application No. 63/225,734, filed Jul. 26, 2021, the entire contents of which are incorporated by reference as if fully set forth herein.

TECHNICAL FIELD

This application describes a method and an apparatus for sealing perforations or cracks found in an oil well casing.

BACKGROUND

The present disclosure relates to sealing cracks, holes and perforations in a subterranean well casing such as an oil or gas well casing or a casing that extracts both oil and gas.

Fractures or cracks occur from time to time in oil/gas well casings. The word "perforations" will be used herein to describe both fractures and cracks within the well casing and the words "fracture" and "crack" will be used interchangeably herein and should be considered to have the same meaning. Presently concrete or grout is used to fill gaps that exist due to perforations in the casing wall. To apply the concrete or grout to the well casing beneath the earth's surface requires multiple people, anywhere from 6 to 10 persons, to construct a rig depending on the size of the job. The rig construction can take 2 days or more to complete. One such process is presently being used by Thru Tubing Solutions of Newcastle, Oklahoma, United States. In brief, an assembly is lowered via the rig to the depth where the fracture or crack is believed to exist. The assembly contains an inflatable section that is inflated to a predetermined pressure securing the inflatable section against the casing wall. Cement is then introduced above the inflatable section until the cement fills the fractures or cracks. The cement unavoidably also fills the interior of the well casing at this location. The assembly is disconnected and the cement is allowed to set. Once the cement is set, the cement within the well casing must be drilled out in order for the well to be utilized. The drilling leaves cement in the casing imperfections, fractures and cracks. Considering the curing time for the concrete, this prior art method is about a 4-day process. Presently, the cost for this procedure is in the $50,000-$100,000 range, and sometimes more. Another issue with this process is that the cement ages and deteriorates over time requiring the process to be done multiple times over the life of the well.

SUMMARY

This disclosure describes a method of sealing perforations, cracks, holes and/or irregularities within a well casing of a subterranean well. The method includes lowering a cylindrical liner assembly within the well casing. The cylindrical liner assembly comprises a cylindrical liner having an inside diameter, a frusto-conical shaped wedge having a diameter slightly larger than the cylindrical liner positioned at a lower end thereof, and a hydraulic cylinder positioned at an upper end of the liner. A rod extends through the liner and is connected at one end to the frusto-conical shaped wedge and is attached to the hydraulic cylinder at the other end. Hydraulic pressure to the hydraulic cylinder is increased sufficiently to pull the frusto-conical shaped wedge into the liner providing sufficient lateral force to force sufficient liner material into the perforations or cracks of the well casing to seal the well casing wall.

In a further embodiment, the method comprises initially lowering a camera into the well casing to identify a location of the perforations or cracks.

In a further embodiment, the method comprises lowering a camera into the well casing to confirm that the well casing has been sealed.

In a further embodiment, the method includes supplying oil to the hydraulic cylinder from a hydraulic oil supply via a hydraulic oil supply line extending from the hydraulic oil supply to the hydraulic cylinder.

In a further embodiment, the method includes increasing oil pressure to the hydraulic cylinder to pull the frusto-conical shaped wedge through a length of the liner sufficient to seal all the perforations or cracks in the well casing wall in a selected area of the well casing.

In a further embodiment, the method includes the liner being made of a brass.

In yet another embodiment this disclosure describes an apparatus for sealing a perforated oil well casing wall wherein the apparatus comprises a hydraulic cylinder attached to an oil supply section at one end and a rod at another end, a cylindrical liner at least a portion of which is a malleable metal, the liner having an outer diameter suitable for entry into the well casing wall; and a frusto-conical wedge being disposed at a lower end of the liner and fixedly connected to the rod, the frusto-conical wedge having a section with a diameter larger than an inner diameter of the liner.

In a further embodiment, the apparatus includes an oil delivery line attached to the oil supply section of the hydraulic cylinder for delivering oil thereto.

In a further embodiment, the liner has an outer diameter such that when the liner is expanded by the frusto-conical wedge, the outer layers of the liner are forced into the perforations or cracks to seal the well casing wall.

In a further embodiment, the frusto-conical wedge is positioned such that the diameter is larger than the inner diameter of the liner at a lower end thereof.

In a further embodiment, the apparatus includes a frusto-conical wedge receiver that engages the frusto-conical wedge to stop the wedge's movement. Then the hydraulic cylinder, threaded rod, wedge, and receiver are recovered from the wedge.

DETAILED DESCRIPTION

This disclosure includes a process for sealing gaps in a subterranean well casing wall such as an oil well casing due to fractures or cracks in the well casing wall. Such gaps introduce dirt, water and debris into the oil well casing and contaminates the oil being extracted from the well.

An oil well is created by drilling a hole into the earth. As the hole is drilled, casings which are sections of steel pipe are placed into the hole being drilled to form a continuous wall that forms a barrier to prevent movement of earth and rock into the hole being drilled.

After drilling and casing the well hole, the created oil well must be 'completed'. Completion includes the process in which the well is enabled to produce oil or gas. In a cased-hole completion, small holes typically called perforations are made in a portion of the casing believed to be adjacent to a production zone. The production zone is where the oil and/or gas resides and from which the oil and/or gas is to be retrieved. The perforations provide a flow path for the oil and/or gas to flow from the surrounding rock into the oil well casing. After the flow path is made, acids and fracturing fluids may also be pumped into the well to fracture, clean, or otherwise prepare and stimulate the reservoir rock in the production zone to optimally permit hydrocarbons to flow into the well casing.

Figure 1:
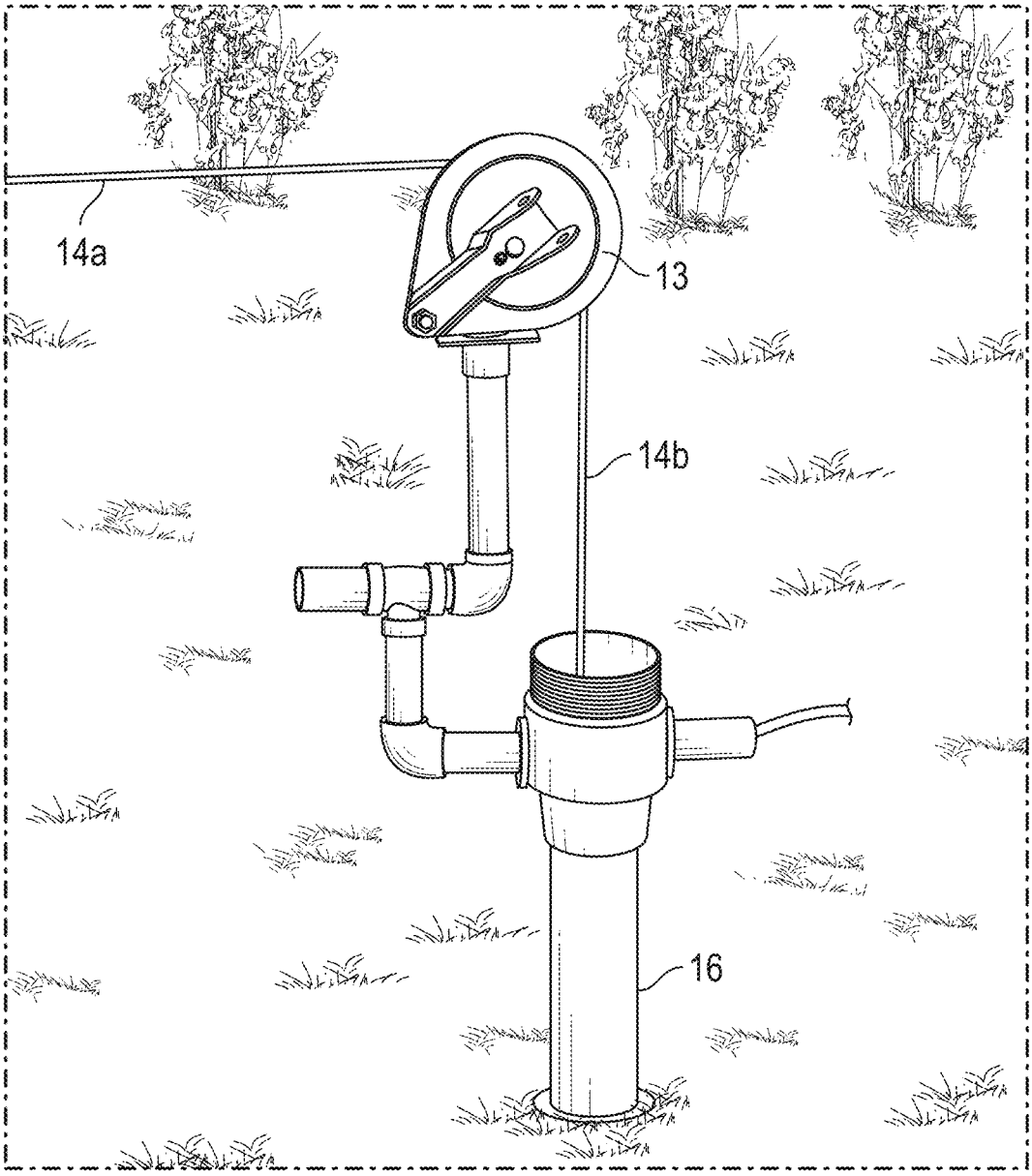
FIGS. 1 and 2 are pictorial views of the equipment used in lowering the apparatus of this disclosure into a well.
Figure 2:
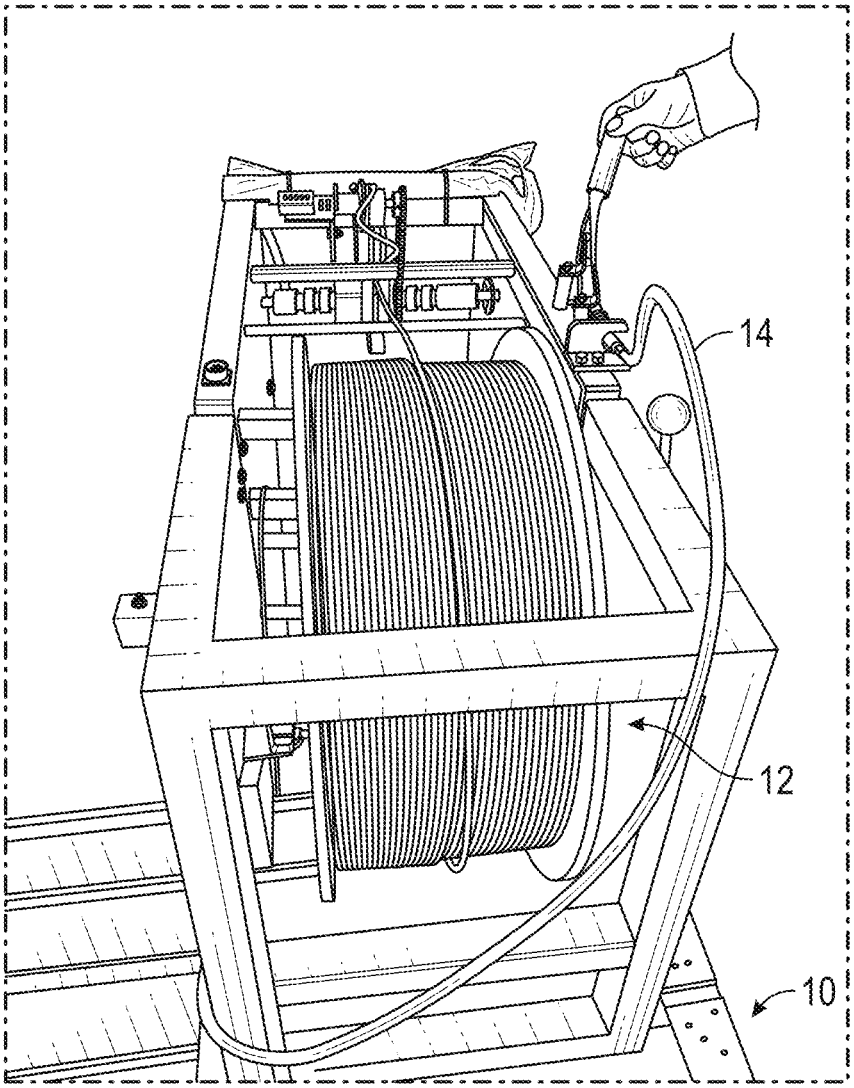
Figure 3:
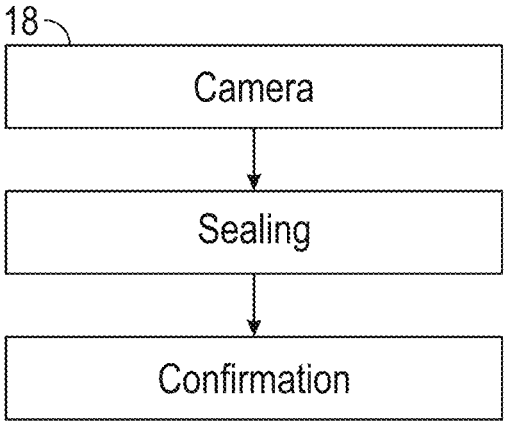
FIG. 3 is a flow diagram of the method of this disclosure.

The present disclosure describes a process that is used to repair the well casing wall when unwanted fractures or cracks occur in the casing wall. Unwanted cracks or fractures of the well casing wall occur for a variety of reasons for which there is no general agreement among industry experts as to any one cause. These cracks or fractures pose a serious problem to any one well up to the point that the well may have to be shut down. The process described in this disclosure provides a cost-effective solution to this problem. As illustrated in FIGS. 1 and 2, one feature of this disclosure is the utilization of a ¼ inch diameter hydraulic umbilical cord 14 which is lowered from the back of a service vehicle 10. The cord 14 is positioned directly above the well opening through the use of a sheave 13 that changes the lie of the cord 14 from being substantially horizontal (14*a*) from the back of the service vehicle 10 to substantially vertical (14*b*) for entering the well 16. The cord 14 serves not only to lower certain items into the well casing but to also supply hydraulic oil which is explained further below. Conventionally, a pulling unit had to be built to carry out this process which required considerable man power. The invention described herein eliminates that manpower and set up time with the illustrated in FIG. 3.

The first step ("Camera" in FIG. 3) includes positioning and traversing a camera 18 inside the casing 15 of the oil well 16 to check the integrity of the casing 15 and to locate any unwanted perforations, such as cracks, fractures or other types of damage to the casing 15 which results in gaps or holes in the casing wall. The camera 18 is typically run the vertical length of the casing 15 all the way to the bottom searching for the integrity of the casing 15. After the unwanted perforations have been located via the camera and the position of the unwanted perforations identified, a video recording of the casing by the camera 18 is also completed. From these recordings, a determination is made as to what depth the repair of the casing wall 15 will occur. The camera is then removed from the well 16 by the winch 12.

Figure 4:
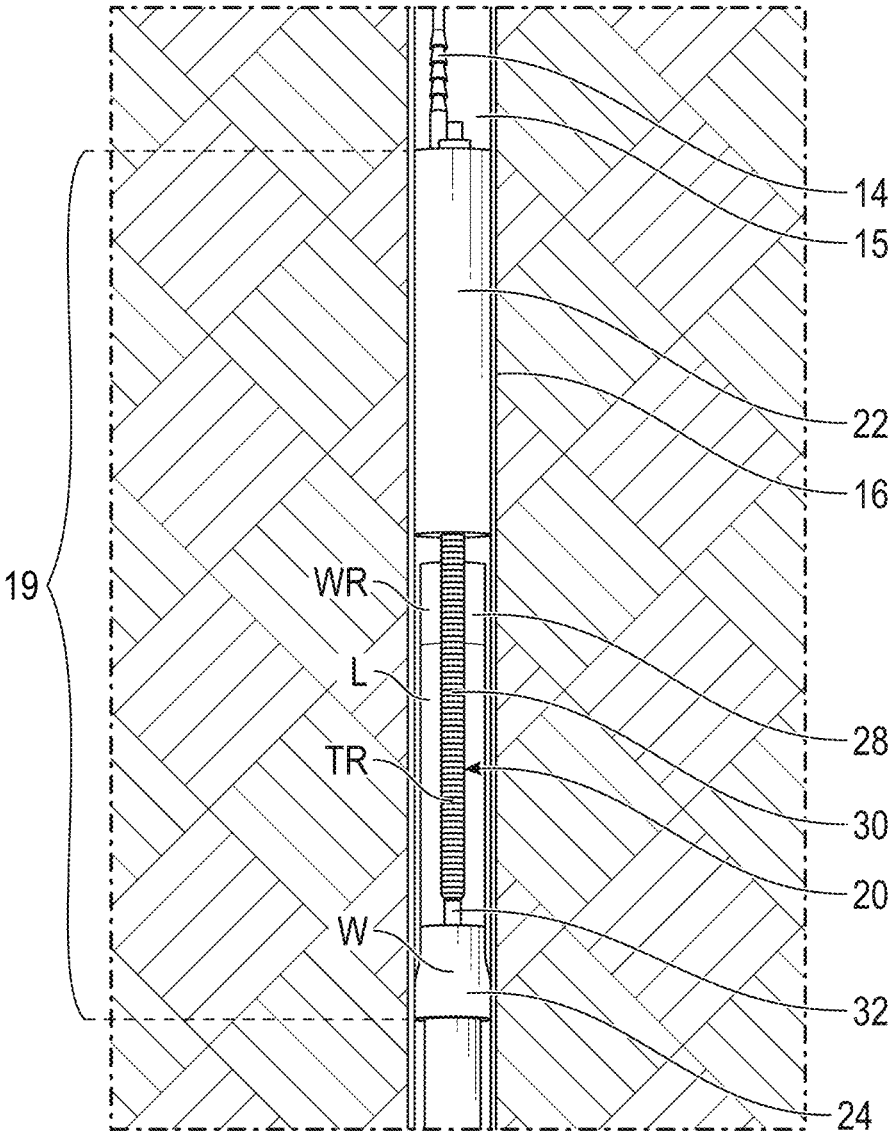
FIG. 4 is a partial cross-sectional view of an oil well casing with the well casing wall sealing assembly of this disclosure.

In the second step (the sealing step of the liner; "Sealing" in FIG. 3) the winch 12 is used to lower an assembly 19 which includes a compression liner 20 and hydraulic cylinder 22 into the casing via the hydraulic umbilical cord 14, as illustrated in FIG. 4. The compression liner 20 is made of a malleable metal designed to expand without compromising the metal's integrity/ultimate tensile strength. In one embodiment the metal is brass. One suitable brass liner was a 4 inch nominal schedule 40 brass pipe 230-H58 C230. The liner 20 can be fabricated to meet varying widths and lengths to meet the casing wall 15 and to ensure a long and strong bond with the casing wall 15.

The assembly 19 further includes a tapered pull-through wedge 24 (W) preferably of a frusto-conical shape. The wedge 24 is tapered with a diameter at an upper end smaller than the diameter of the liner 20 (L) and has a larger diameter than the liner at a lower end. The wedge is positioned just on the inside of a lower side of the compression liner prior to lowering the assembly 19 into the well casing 15. The assembly 19 also includes a wedge receiver 28 (WR) made of low carbon steel that is positioned on an upper side of the compression liner 20.

The wedge receiver 28 and the wedge 24 are assembled, adjoined and aligned with a threaded rod 30 (TR) made of a high strength steel. The wedge 24, liner 20, wedge receiver 28 and hydraulic cylinder 22 as an assembly are lowered into the well casing to the depth determined in Step 1. As illustrated in FIG. 4, the assembly 19 is assembled by attaching the threaded rod to the hydraulic cylinder, then attaching the receiver with the threaded rod extending through the receiver. The liner is then positioned with the rod extending through it and the wedge is attached to the distal end of the threaded rod below the liner.

A hydraulic pump preferably situated on the service truck 10 provides motive force through hydraulic oil via a fluid connection through the umbilical cord 14 which is connected to the hydraulic cylinder 22. The umbilical cord 14 provides an oil pathway from the hydraulic pump to the hydraulic cylinder. With this connection, the hydraulic pump can increase pressure to the hydraulic cylinder which in turn transmits a lateral force to the compression liner 20 sufficient to force material of the liner 20 into the perforations in the casing wall 15.

It has been found that about 3500 psi. of hydraulic pressure is sufficient to cause this phenomenon. Hydraulic pressure of this magnitude will cause the compression liner to be expanded with enough force to fill in all the perforations of the well casing wall including any micro fractures with compression liner material.

As hydraulic pressure is increased by the hydraulic pump through the hydraulic umbilical cord 14, the increase in pressure activates the hydraulic cylinder. With the hydraulic cylinder being positioned above the compression liner 20 and being attached to the wedge 24 with the rod 30 which extends though the inside of the compression liner 20, the hydraulic cylinder retracts the rod 30, pulling the wedge 24 into the compression liner 20. As the wedge travels through the liner 20, liner material is forced into the perforations.

The wedge receiver 28 acts as a barrier between the hydraulic cylinder 22 and the liner 20 and retains the liner 20 in a selected vertical position with respect to well casing 15 and the perforations to be sealed. The wedge receiver also acts as a receiver for the hydraulic wedge after it passes through the liner.

As pressure increases in the hydraulic cylinder and the rod 30 retracts upwardly within the liner 20, the wedge 24 moves into the inside of the compression liner 20. The wedge provides a lateral force, forcing the outer surface and sealing part of the compression liner 20 to come into sealing contact with the inside surface of the well casing 15. The force provided by the wedge 24 essentially extrudes the outer surface of the compression liner 20 into the perforations located in the casing wall 15 thereby filling gaps and holes in the well casing wall 15, sealing the well casing wall.

As hydraulic pressure is raised further in the hydraulic cylinder via the hydraulic umbilical cord, the wedge is pulled further into the compression liner 20. In one particular embodiment, the pressure required to completely pull the wedge through the compression liner was about 3,500 psi. At this pressure for this embodiment, approximately 3,500 psi was sufficient to fill in the holes and seal the casing wall 15. The pressure was maintained at about 3500-3600 psi until the wedge 24 was pulled completely through the compression liner 20 and stopped by the wedge receiver 28. It should be understood that for any diameter size well casing, a suitably sized compression liner and wedge are needed to provide the necessary seal without damaging the well casing.

Once the wedge has completely moved through the liner, the hydraulic pressure will climb past about 3,500 psi as it travels into the receiver. The wedge's upward movement is being stopped by the wedge receiver 28. At this point the hydraulic cylinder is pulling against the wedge receiver and not against the force required to fill in the perforations with liner material.

The hydraulic wedge will pass through the liner into the receiver at the bottom of the hydraulic cylinder. At that point, the upper portion of the liner is pulled into the receiver. The receiver acts as a stabilizer by keeping the rod straight along a vertical axis of the well casing so that the wedge can be easily removed from the well casing without twisting thereby avoiding damage to the well casing. Once the wedge and receiver meet the hydraulic cylinder, receiver, rod, and wedge are recovered as a unit. The hydraulic cylinder, receiver, rod, and wedge are pulled out of the well with the winch.

The final step in the process of this disclosure is to confirm that the perforations have been sealed. In one embodiment of this disclosure to ensure the compression liner is correctly in place is to lower the camera, via the winch, to the depth that the compression liner was installed. The section of well casing where the compression liner is installed is recorded photographically and on video. Any section of well casing which has perforations and which is not sealed by the liner will be exposed by the photographs and the video. The camera is then retrieved from the well using the winch.

Figure 5:
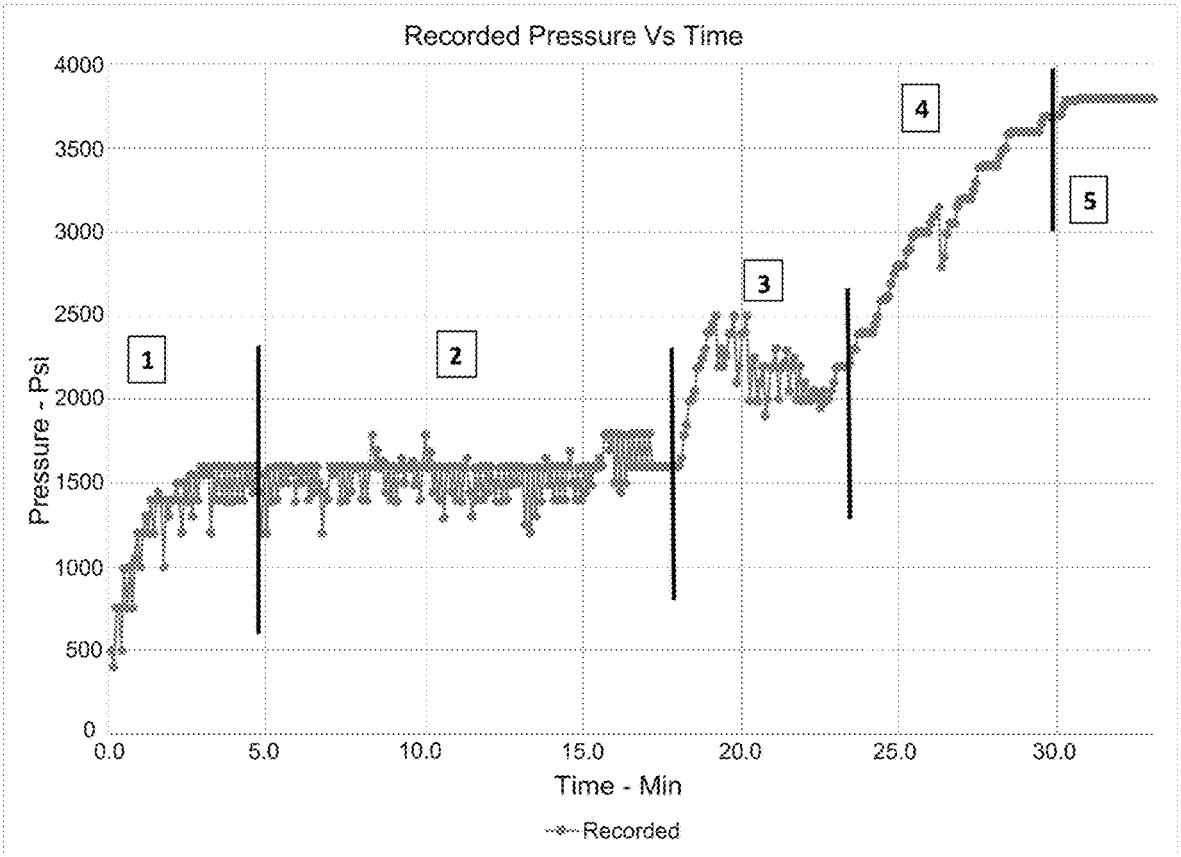
FIG. 5 is a graphical view of the hydraulic pressure used in one instance to move the wedge through the liner.

A test of the hydraulic pressure experienced to move the wedge through a liner to cold weld the liner with a casing wall is discussed below. FIG. 5 shows the pressure profile experienced moving the wedge through the liner.

BACKGROUND INFORMATION

The liner used in this test was honed out for the first approximately 17.75 inches and at a normal thickness for the following approximately 5 inches, making the total liner length of approximately 22.75 inches. The receiver had a length of approximately 5.875 inches meaning the wedge traveled approximately 28.625 inches in a time of approximately 33.1 minutes.

In section 1 of FIG. 5, the pressure gauge did not start reading until the wedge contacted the liner. Section 1 shows the pressure continuing to build up and drop until the wedge was fully in contact with the liner.

At the start of section 2, the pressure reached around 1600 psi. A pattern emerges of the pressure reaching about 1600 psi and then dropping repeatedly for about 15 minutes. Some points throughout the data indicated the pressure built up more than about 1600 psi which can be explained by debris in the way when looking at the middle of the section, or when looking at the end of the section is most likely because the wedge is now begging to reach the thicker part of the liner.

Similar to section 2, section 3 shows the pressure building up and dropping in a pattern for around 6 minutes. This pressure gets to about 2500 psi and then drops and repeats this for approximately 2 minutes, then gets up to about 2300 psi and drops and repeats this for another 3 minutes. This is because the wedge initially requires more pressure to move into the thicker region of the liner and then can move throughout when fully surrounded at a lower pressure.

In section 4, the pressure builds up for the whole time. This is likely due to the wedge coming into contact with the receiver. The receiver is made from steel making it a lot stronger than the brass liner and therefore the wedge requires more pressure to move through it. Evidence of the wedge moving can be seen from the pressure drop in the middle of section 4 and from the visual inspection during the test, the rod was moving at this point at a semi-constant pace.

Section 5 shows the wedge is now fulling inside the receiver and has nowhere else to move, this can be shown from the constant pressure at approximately 3800 psi for around 3 minutes. This shows the liner has now been fully attached to the casing, which would be helpful when the whole system is downhole.

The information in FIG. 5 illustrates that the wedge moves related to the pressure of the hydraulic cylinder. It also shows the pressure required for the wedge to move through certain thicknesses of the liner. Finally, during each pressure build-up, it can be concluded that the wedge is applying pressure in a constant spot on the liner and in return enables the liner to cold weld to the casing. Once the pressure drops the wedge will move forward and expand the next part of the liner into the casing, and then from there, the pressure will build up again, which cold welds the next section of the liner. It follows this process throughout the data, showing that the liner does cold weld throughout the whole liner and not just the thick sections on the ends of the liner.

What is claimed is:

1. A method of sealing a well casing of a subterranean well, the well casing having perforations or cracks at a section of the well casing, the method comprising:

lowering a cylindrical liner assembly into the well casing, the cylindrical liner assembly comprising:

a cylindrical liner having an inside diameter;

a frusto-conical shaped wedge having a diameter larger than the inside diameter of the cylindrical liner, the frusto-conical shaped wedge being positioned at a lower end of the cylindrical liner;

a hydraulic cylinder positioned above the cylindrical liner;

a wedge receiver positioned between the hydraulic cylinder and the cylindrical liner; and a rod extending through the cylindrical liner, the rod being connected to the frusto-conical shaped wedge at a first end and attached to the hydraulic cylinder at a second end opposite to the first end;

increasing hydraulic pressure to the hydraulic cylinder to pull the frusto-conical shaped wedge through the cylindrical liner, wherein the wedge receiver receives the frusto-conical shaped wedge entirely within the wedge receiver after the frusto-conical shaped wedge has traveled through the liner; and providing lateral force to force liner material into the perforations or cracks of the well casing to seal the well casing.

2. The method of claim 1 and further comprising, prior to lowering the cylindrical liner assembly, lowering a camera into the well casing to identify a location of the perforations or cracks.

3. The method of claim 1 and further comprising, after providing lateral force to force sufficient liner material into the perforations or cracks, lowering a camera into the well casing to confirm that the well casing has been sealed.

4. The method of claim 1 and further comprising supplying oil to the hydraulic cylinder from a hydraulic oil supply via a hydraulic oil supply line extending from the hydraulic oil supply to the hydraulic cylinder.

5. The method of claim 4 wherein increasing hydraulic pressure to the hydraulic cylinder comprises increasing a pressure of the oil supplied to the hydraulic cylinder to pull the frusto-conical shaped wedge through a length of the liner to seal off all of the perforations or cracks in a selected area of the well casing.

6. The method of claim 1 wherein the frusto-conical shaped wedge pulls the cylindrical liner into the wedge receiver.

7. The method of claim 6 wherein when the wedge is received entirely within the wedge receiver, the wedge receiver prevents the wedge from twisting during removal from the well casing by keeping the rod straight along a vertical axis of the well casing.

8. The method of claim 1 wherein at least a portion of the liner is made of a brass.

9. An apparatus for sealing a perforated or cracked oil well casing, the apparatus comprising:

a hydraulic cylinder with an oil supply section at a first end and a rod at a second end opposite to the first end;

a cylindrical liner, wherein at least a portion of the cylindrical liner comprises a malleable metal, and the liner has an outer diameter that is smaller than a diameter of the well casing;

a frusto-conical wedge disposed at a lower end of the cylindrical liner, and having a section with a diameter larger than an inner diameter of the cylindrical liner; and a wedge receiver fixedly connected to the rod, wherein the wedge receiver receives the wedge entirely within the wedge receiver after the wedge is pulled through the cylindrical liner.

10. The apparatus of claim 9 and further comprising an oil delivery line attached to the oil supply section of the hydraulic cylinder.

11. The apparatus of claim 10 and wherein the wedge receiver receives entirely the frusto-conical wedge to stop movement of the wedge with a force sufficient to overcome a preselected hydraulic pressure.

12. The apparatus of claim 9 wherein the outer diameter of the cylindrical liner is such that when the cylindrical liner is expanded by the frusto-conical wedge, the outer layers of the cylindrical liner are forced into the perforation or crack to seal the casing wall.

13. The apparatus of claim 9 wherein the frusto-conical wedge is positioned such that the section of the frusto-conical wedge with a diameter larger than an inner diameter of the cylindrical liner is a lower end of the frusto-conical wedge.

* * * * *